US005480337A

United States Patent [19]

Baker

[11] Patent Number: 5,480,337

[45] Date of Patent: Jan. 2, 1996

[54] COMBINATION DIVERSE DOLL AND EDUCATIONAL ACTIVITY PLAYSET METHOD

[76] Inventor: Jennifer K. Baker, 170 W. Laurel St., Philadelphia, Pa. 19123

[21] Appl. No.: 309,905

[22] Filed: Sep. 21, 1994

[51] Int. Cl.[6] ..... A63H 3/16

[52] U.S. Cl. ..... 446/100; 446/321

[58] Field of Search ..... 446/100, 99, 98, 446/97, 320, 321, 268, 369, 370, 381, 384, 376, 332

[56] References Cited

U.S. PATENT DOCUMENTS

| | | | |
|---|---|---|---|
| 1,008,619 | 11/1911 | Spear | 446/99 |
| 1,509,604 | 9/1924 | Myers | 446/99 |
| 1,566,801 | 12/1925 | Millard | 446/99 |
| 1,609,899 | 12/1926 | Bigelow . | |
| 2,059,964 | 11/1936 | Hempstone | 35/35 |
| 2,199,049 | 4/1940 | Greenberg | 446/100 |
| 2,536,518 | 1/1951 | Shrier | 46/123 |
| 2,944,368 | 7/1960 | O'Brian et al. | 446/100 |
| 3,512,741 | 5/1970 | Goldstein | 446/268 |
| 3,789,522 | 2/1974 | Moore | 35/60 |
| 3,921,332 | 11/1975 | Terzian et al. | 46/161 |
| 4,030,235 | 6/1977 | Terzian et al. | 46/11 |
| 4,030,240 | 6/1977 | Port | 446/321 |
| 4,076,155 | 2/1978 | Calvin | 446/321 |
| 4,092,785 | 6/1978 | Foreman | 35/1 |
| 4,139,067 | 2/1979 | Kuna et al. | 46/12 |
| 4,166,337 | 9/1979 | Kosicki et al. | 46/232 |
| 4,529,385 | 7/1985 | Reiner et al. | 434/171 |
| 4,867,574 | 9/1989 | Kobayashi | 446/72 |
| 4,921,459 | 5/1990 | Cook et al. | 446/321 |
| 4,921,461 | 5/1990 | Fujikawa | 446/296 |
| 4,950,194 | 8/1990 | Gullace | 446/72 |
| 4,992,068 | 2/1991 | Conrad | 446/85 |
| 4,993,987 | 2/1991 | Hull et al. | 446/268 |
| 5,021,020 | 6/1991 | Hambly et al. | 446/98 |
| 5,055,083 | 10/1991 | Walker et al. | 446/478 |
| 5,067,924 | 11/1991 | Munter | 446/320 |
| 5,149,289 | 9/1992 | Edwards et al. | 446/321 |
| 5,167,561 | 12/1992 | Rizzo | 446/320 |
| 5,299,968 | 4/1994 | Bennett | 446/394 |

*Primary Examiner*—Robert A. Hafer
*Assistant Examiner*—Michael O'Neill
*Attorney, Agent, or Firm*—Eckert Seamans Cherin & Mellott

[57] ABSTRACT

A combination doll and educational activity playset allows a youthful user to playact in adult activities and careers without social pressure respecting compliance with idealized expectations as to weight and figure. A wardrobe, props and instructions sheets respecting the careers and activities are provided. The doll is assembled from a headless body, a hairless head chosen from a range of heads likely to resemble the user in later years, and a hair wig that likewise is intended to resemble the user. The doll body has only an average figure, for example representing a 15% body fat level that is distributed relatively more to the girth and hips than elsewhere. The heads and hair wigs resemble a range of appearances, such as different ethnic or racial types. The realistic body and user-resembling features can resemble the mother of the children who play with the doll. Social pressure to have a perfect slim figure is reduced, with emphasis more appropriately directed to roll playing in adult activities and situations, without emphasis on perfect bodily form.

3 Claims, 6 Drawing Sheets

COMBINATION DIVERSE DOLL AND EDUCATIONAL ACTIVITY PLAYSET METHOD

Insofar as this disclosure may contain material subject to copyright protection, the copyright owner has no objection to unlimited reproduction by anyone of the patent disclosure or any portion of the Patent Office file, but otherwise reserves all copyrights.

BACKGROUND OF THE INVENTION

1. Field of the Invention

The invention relates to toy dolls and activity playsets, and in particular concerns a combination doll and activity playset.

2. Prior Art

The toy market includes various dolls, with associated wardrobes styled around certain themes. Typical dolls have idealized physical proportions that resemble at most only a fraction of actual people. Play activities available with the dolls, to the extent they are available, revolve to a large extent around wardrobe choices. In order to provide a variety of thematic play activity choices, a doll playset might include a collection of choices that have doubtful logical association. For example, a policewoman doll's wardrobe might include a formal ball gown and a one-piece bathing suit. Such play choices are expected to provide a fertile ground for imagination with respect to various potential career choices and the like.

The idealized physical proportions and flawlessness of known dolls are unreal. The typical designer of a mature form of doll strives to represent, for example, the most popular girl in school, such as the high school prom queen, or the most attractive, e.g., a Miss America type. These dolls typically have a tiny waist and a full bust, a straight and narrow nose with a pleasing point, disproportionately small feet and hands, and disproportionately large eyes and eyelashes.

Most of the children who use such dolls cannot expect to develop a body with proportions resembling those of the dolls. Thus the dolls give children unreal expectations about how their bodies will or should develop. The dolls contribute to a lack of self-esteem that unfortunately is bolstered by advertising and television programming wherein depicted role models typically represent "the perfect woman" insofar as possible. Beginning at critical pubescent years, young girls can become unreasonably disillusioned because the ideal body that they have been taught to value or to hope for, fails to materialize.

Conventional dolls and their associated action wardrobe selections subordinate meaningful educational activities to physical attractiveness. These dolls send a wrong message to their youthful users. It would be advantageous if a combination doll and activity playset could be developed that does not emphasize idealized physical good looks, instead providing meaningful educational opportunities that go to activity aspects, as opposed to a rigid conformity of physical aspects of the doll's appearance with unrealistic ideals.

SUMMARY OF THE INVENTION

It is an object of the invention to provide a combination of a diverse doll and educational activity playset that teaches children the primary importance of self-worth and/or education while subordinating emphasis on role models characterized by ideal or even statuesque body proportions.

It is another object of the invention to provide a doll with a body that is realistically thickened in mid portions, especially the waist, hips and legs, to teach activity over appearance as leading to an engrossing and enriching life.

It is also an object of the invention to provide a realistic doll in the form of a composite of modular components, whereby the purchasing public can choose from among a range of features for their doll, especially features that represent the intended youthful user. For this purpose, the selection of facial features can be diverse and, for example, including options suggestive of different ethnic and/or racial backgrounds.

It is a related aspect that the modular components of the doll include a selection from interchangeable wigs, to permit a choice of hair styles and/or hair textures to suit the user's tastes or features as to the appearance of the hair.

It is a further object of the invention to facilitate in playsets as described, aspects of role-playing in mature situations, especially productive careers.

These and other aspects and objects are provided according to the invention in a combination doll and activity playset. The combination comprises a doll body adapted to receive a head, a choice of various hairless doll heads, and a choice of hair wigs. The doll body can have articulated limbs for positioning the doll in more or less natural poses. The doll body preferably has a female form, but is proportioned to resemble a statistical average female body rather than an idealized one. Preferably, for example, the doll body is proportioned to appear to have at least about 15% body fat distributed realistically, for example mostly at the waist, hips and legs of the body.

The limbs are thus more realistic and less ideal. This reduces emphasis on thinness and supports considerations of self-worth and fulfillment, such that the doll is especially useful with an action playset where the user can devote her time to engrossing careers and/or educational aspirations.

The doll heads are interchangeably received in the body and each has a locking projection for a neck part extending into a cooperative socket in the body. The head is chosen from a range of heads, covering a selection of shapes and facial features representative of different ethnic and racial types. The wigs likewise are selected from a range of variation of color, hair style, length and/or texture. Each wig has locking means for releasably locking onto a doll head.

A user can thus build a doll that represents herself, as opposed to representing some potentially unrealistic sexual ideal. Users can look to female relatives and the like for the typical appearance of an adult female, and although the user can be as optimistic as desired as to future appearance, the reliance is on reality rather than commercially defined stereotypes.

This emphasis preferably is carried forward in the accessory and wardrobe aspects of the playset. The activity playset includes a carrying case, a wardrobe, props and preferably instruction sheet(s) relating to career activities and the like. The carrying case is releasably closable and sized for hauling the wardrobe, props, a doll body and at least one chosen head and wig. The wardrobe is sized to adorn the doll body and styled for role-playing. The props are chosen to provide for activities complementary to at least one adult career choice. The instruction sheet(s) may suggest activities, explain or depict a certain activity, and generally to provide an opportunity for the user to imagine what it would be like to lead a life of a certain career or explain how to pursue an educational and/or career path to achieving certain career goals.

The activity set emphasizes mature pursuits such as career activities, and de-emphasizes idealized physical beauty. The activity set is thus operable to better instill children with a sense of self-worth and to encourage them to lead challenging and enriching lives regardless of their particular physical attributes. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 2*a*–2*c* are orthogonal views of the doll body in FIG. 1, wherein:

FIG. 2*a* is an enlarged front elevation view thereof;

FIG. 2*b* is a side view thereof; and,

FIG. 2*c* is a rear view thereof.

FIGS. 3*a*–6*b* depict various embodiments of the doll head in accordance with the invention, wherein:

FIGS. 3*a* and 3*b* are respectively an enlarged front elevation view and a side elevation view of the doll head in FIG. 1, representing a first choice of doll head;

FIGS. 5*a* and 5*b*, and 6*a* and 6*b*, represent two additional alternatives, the sets of FIGS. 3*a*/3*b* through 6*a*/6*b* representing a range of different facial configurations.

FIGS. 7*a*–8*f* depict various embodiments of the doll wig in accordance with the invention, wherein:

FIG. 7*a* is an enlarged front elevation view of the doll head and wig in FIG. 1, in the same exploded positions;

FIG. 9*b* for a farmer; FIG. 9*c* for a veterinarian; and, FIG. 9*d* for a scientist.

FIG. 10*b* for the scientist; FIG. 10*a* for the veterinarian; and, FIG. 10*d* for the hair designer.

DETAILED DESCRIPTION OF THE PREFERRED EMBODIMENTS

Figure 1:
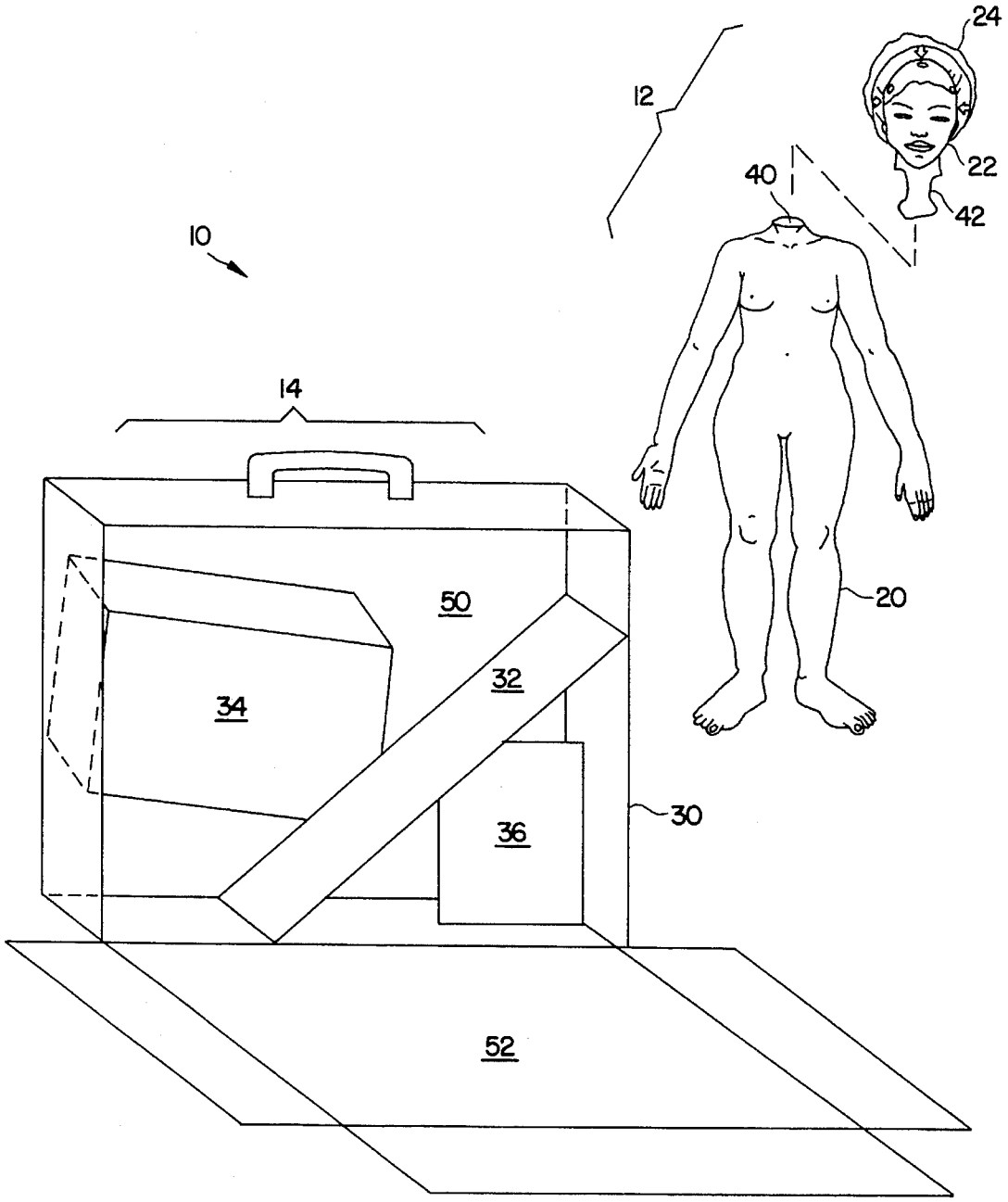
FIG. 1 is a perspective view, partly exploded, showing the combination of a customized doll and educational activity playset according to the invention.

In FIG. 1, a combination 10 in accordance with the invention includes a doll 12 of realistic appearance and subject to customization, and an educational activity playset 14. The doll 12 comprises a headless body 20 and one or more hairless heads 22 and one or more wigs 24 which can be put together and taken apart by a child who plays with the doll 12. The head 22 and wig 24 used for the doll is chosen from a range of available appearances, whereby the doll is customized. The playset includes a carrying case 30 having a package of props 34, a package of one or more wardrobes 32, and instruction sheets 36 relating to a given educational activity, preferably scenarios to be emulated when playing with the doll, relating to challenging and interesting activities such as career situations.

The doll body 20 is formed with a socket 40 in the neck region, and the hairless head 22 is formed with a locking projection 42 for releasably extending into the socket 40. The hairless head 22 and the hair wig 24 are releasably attachable in a similar manner.

The carrying case 30 has a handle for portability, and has rectangular sidewalls defining a generally rectangular compartment 50. One sidewall is hinged and acts as a flap 52 to move between open and shut positions. The flap 52 includes a suitable means of closure such as snaps or zippers. The sidewalls further have external and internal surfaces which can be decorated with ornamentation consistent with the given educational activity that is chosen from various alternatives. In the example of career activities, such ornamentation can be consistent with the activities, for example, of a veterinarian, a scientist, a hair dresser and/or a farmer. Other similar groupings of activities and careers can be provided for.

The doll head 22 and wig 24, and the wardrobes 32 and props 34 are made in a variety of embodiments to provide the purchasing public with a range of alternative components for the doll 12 in accordance with their own wishes for the doll. Preferably, such choices are representative of a number of different sorts of people of generally characteristic stereotypical appearance; however, the choices are representative of a range of real people and the purchaser is therefore able to customize the doll as a representation of the intended user as an adult, as opposed to an idealized representation of a slim and flawless model.

The ultimate adult size of a youthful user is open to substantial question. The doll body 20 preferably is provided in one size so that the various wardrobes need only be made likewise in one size. This size is chosen to represent the statistical norm of adults.

Figure 2C:
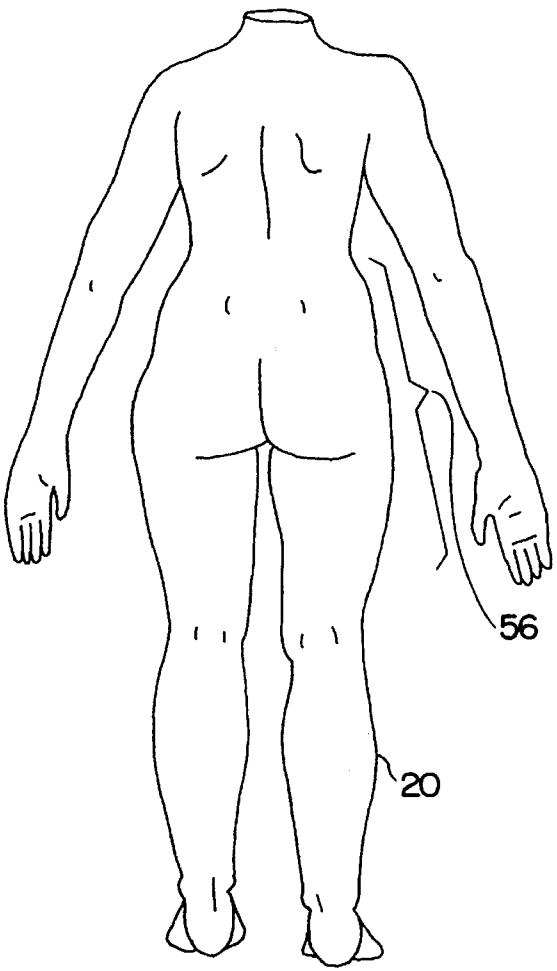
Figure 2B:
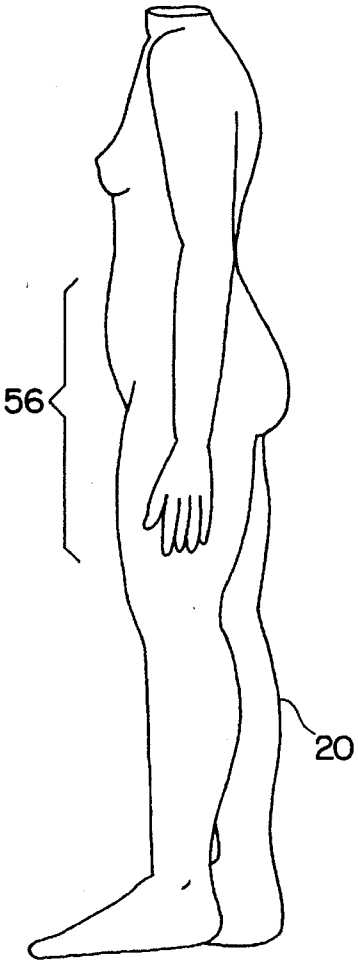
Figure 2A:
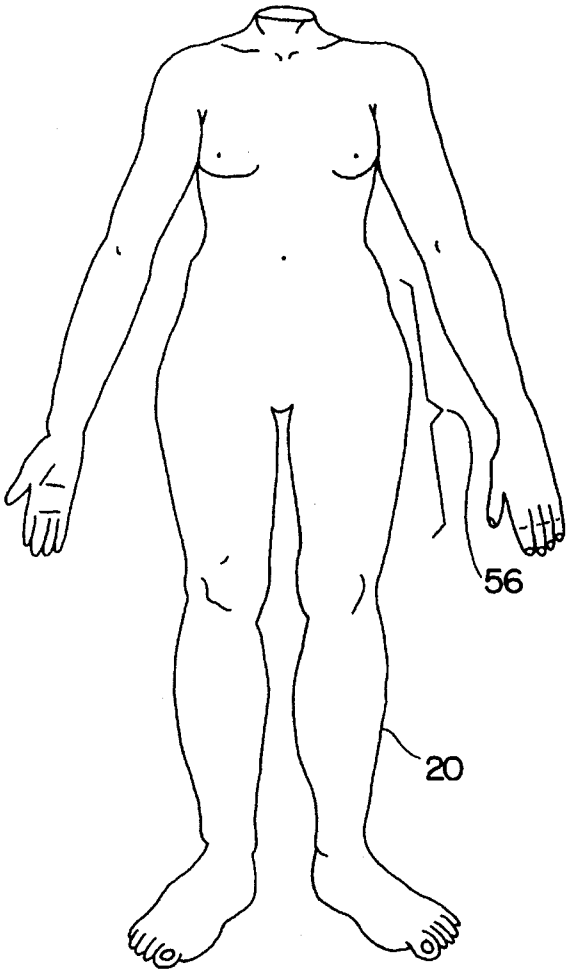
Figure 3A:
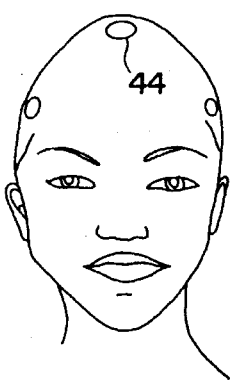
Figure 3B:
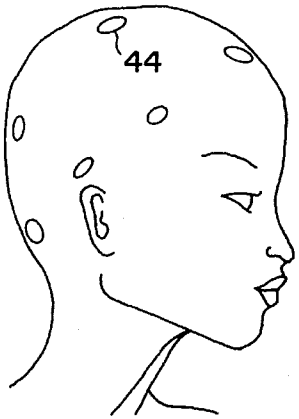
Figure 4A:
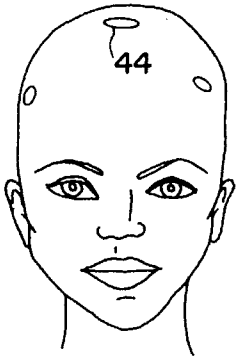
FIGS. 4*a* and 4*b* are likewise an enlarged front elevation view and a side elevation view of an alternative choice of the doll head.
Figure 4B:
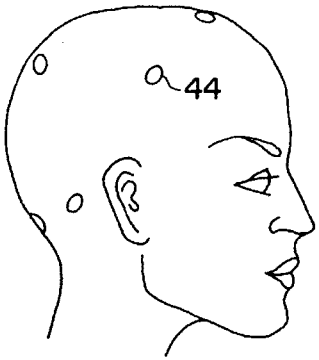
Figure 5A:
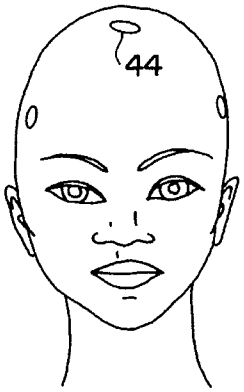
Figure 5B:
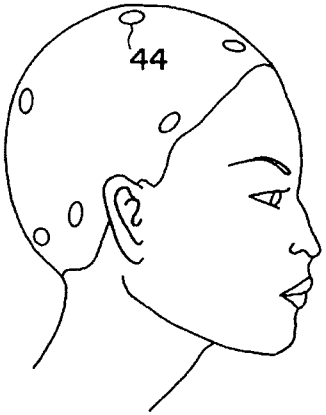
Figure 6A:
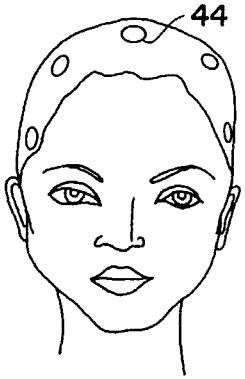
Figure 6B:
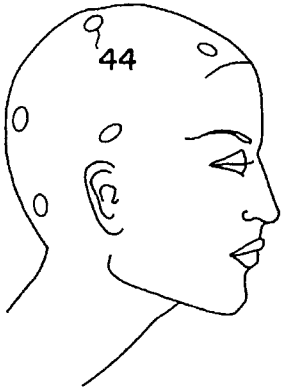

In FIGS. 2*a*–2*c*, the doll body 20 has the anatomical aspects characteristic of an adult female, or perhaps that of teenager, in any event the form simulating the appearance of the user after some years of further development from the age at which the user plays with the doll. Of course a male version is also possible and typically the user will choose to play with a doll of her or his own gender or to assemble groups including members of both genders, of which one doll can represent the user in later life during play. It is not essential to the invention that the children playing with the doll 12 be able to accurately estimate any particular age, the children can simply supply an age that they wish.

The structure of the invention enables the children to see themselves as the doll 12 due to choices of appearance and potential career activities that resemble the user's appearance and proclivities. Users can therefore play-act in roles or activities that they foresee themselves experiencing sometime in their mature future or that they might like to experience vicariously through the doll.

The doll body 20 can be molded from a suitably flexible elastomeric material, and be supported by an internal structure (not shown) forming conventional articulated connections for the limbs. The doll 12 can be positioned and moved about to simulate activities with the limbs disposed in natural positions and poses.

An inventive aspect of the doll is that the proportions of the body 20 are chosen to simulate statistical norms as opposed to idealized unrealistic figures. The body 20 thus can be proportioned, for example, to appear as having at least about 15% body fat, or more, distributed to some extent at the waist, hips and leg portions 56 of the body, and perhaps including the ankles and other limbs as well.

The body 20 is purposely proportioned to the statistical norm for several reasons. Studies have shown that many women regard only figures characteristic of the thinnest young commercial models as attractive, which is an unrealistic ideal that should not be imparted to youthful users of dolls. It is not reasonable and puts undue psychological pressure on maturing females to suggest that their worth is reduced by failure to comply with an ideal that is inappropriately demanding. For many women attempting and/or failing to comply with the ideal may be physically and psychologically unhealthy.

The body 20 is not proportioned to be unattractively large or obese. It preferably is merely simulative of the statistically normal woman. Thus the body does not stimulate negative reactions in children who play with the doll, nor in the mothers of those children, which typically are primary purchasers of the doll 12 as well as the persons whose physical appearance is most likely to be reflected in that of their adult female children. Rather, the body 20 is sized and shaped to stimulate positive feedback and a realistic estimation of adulthood.

Of course, some children will in fact mature into slim model types. The point is to represent the body 20 in a relatively thickened and less sexually emphatic nature as compared to conventional dolls representative of adults or teenagers, so as to reduce any a notion a young child may have that her body will or should mature into an object of universal admiration, as typical of the prior an prom queen forms of dolls. Thus doll 12 more effectively reinforces healthful notions, and a belief that in maturity, activities await the child that are engrossing and enriching regardless of her eventual body proportions. The child's ambitions and self esteem need not turn on superficial considerations; the child can be expected to retain more confidence when maturing; and the child will be less prone to guilt and perhaps less subject to psychological difficulties associated with the current social pressure to be thin, such as anorexia nervosa, bulimia, and so on.

Body 20 as shown is an example of purposed thickening in the limbs, hips and the like. Other variations are possible according to the invention, involving different specific degrees of thickening, different relative proportions of height and width or of anatomical specifics such as thighs, breasts and the like, provided the doll represents a more statistically typical human body as opposed to the statuesque ideal that is typified by prom queen dolls that pervade the toy market. This can be achieved substantially by representing doll 12 as a large framed person, e.g., where an adult of five feet, four inches height (about 1.6 m) would weigh about 150–155 lbs. (about 70 kg). Alternatively, the relative proportions can be adjusted for realism. With this in mind, terms like "thickened" and "realistic" are used for convenience in this description rather than to limit the invention to specific alterations or proportions that render body 20 more statistically normal as described.

FIGS. 3*a*–6*b* show a series of alternative doll heads 22 from which the purchaser of an activity set and doll according to the invention can choose to provide a desired type of head to complement the natural form body 20. The decision maker may be the child or the child's mother, etc. Typically, the buyer seeks to simulate the expected adult appearance of the child who will play with the doll; however, this is not a strict requirement. The range of different heads 22 represent a range of shapes having characteristics such as facial details intended to simulate a range of ethnic and/or racial types among the purchasing public and/or a range of different general proportions within racial or ethnic types. The four appearances that are shown are exemplary of numerous other variations that are routinely possible. There is no presupposition that children want to own a doll face that most nearly reflects their own and/or their mothers. However, the multiple interchangeable doll heads 22 in accordance with the invention will provide that versatility to the purchasing public that wishes it, for the purpose of most nearly simulating the adult appearance of the user of the doll.

Figure 7A:
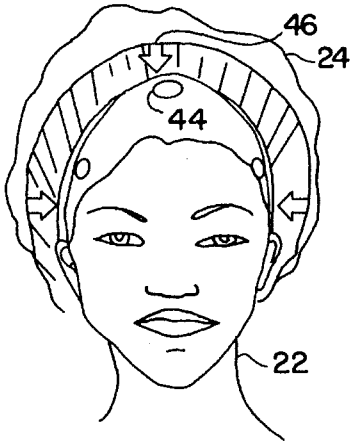
Figure 7B:
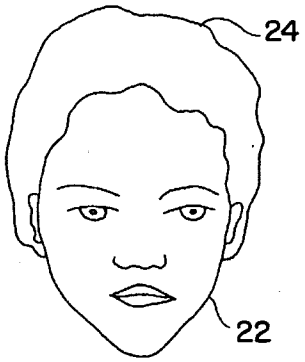
FIG. 7*b* is a view corresponding to FIG. 7*a*, with the wig releasably attached to the head.
Figure 8A:
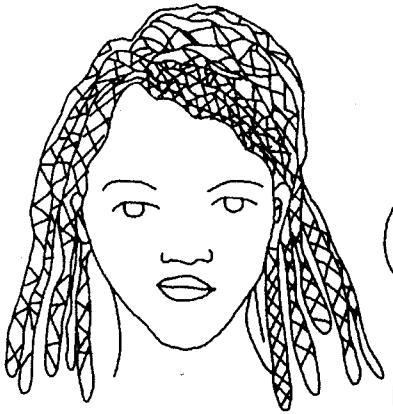
FIG. 8*a* is a front elevation view of an alternative embodiment of the wig releasably mounted on an exemplary one of the heads; and, FIGS. 8*b*–8*f* are front elevation views corresponding to different embodiments of the wig releasably mounted on exemplary ones of the heads, these different embodiments representing alternative choices for customizing the configuration of the doll.
Figure 8B:
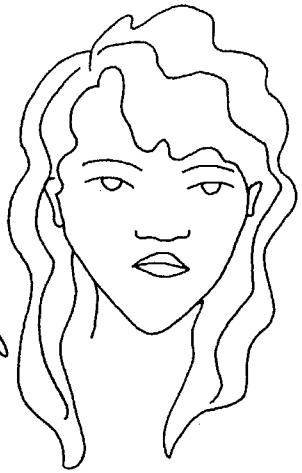
Figure 8C:
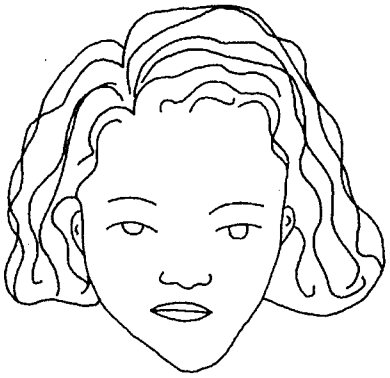
Figure 8D:
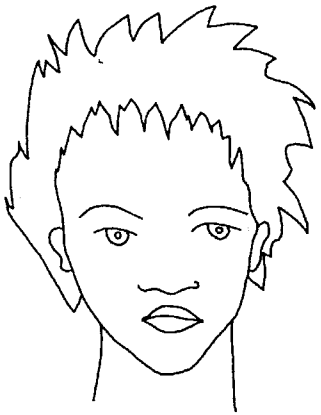
Figure 8E:
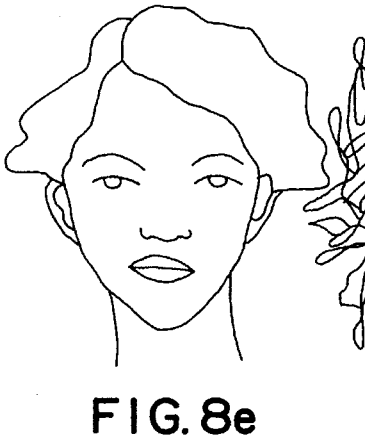
Figure 8F:
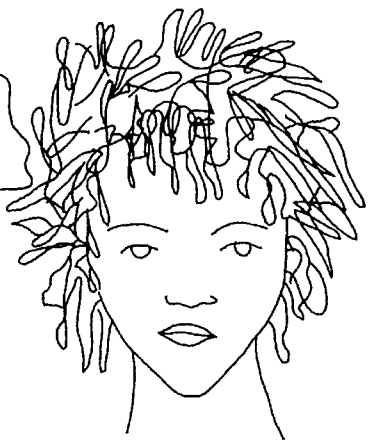

FIGS. 7*a* and 7*b* show the wig 24 and head 22 in detached and attached relative states, respectively. Wig 24 has hair carried by an under-structure formed with locking projections 46 or similar fasteners for extending into sockets 44 formed in head 22. Thus the wig 24 can be easily attached and detached to allow for change in a hair style and/or hair texture. FIGS. 7*b* to 8*f* show a number of different configurations for wig 24 for interchangeable use on any one of the doll heads 22. Although seven different embodiments are shown, the number of routine variations possible in accordance with teachings of the invention is unlimited.

It is preferred to provide a large number of choices in the doll hair styles and/or hair textures because natural individuals easily change their hair style or color, and such a capability in the doll is simulative of real choices the user may eventually make. Additionally, the hair styles, textures and colors preferably complement the different head forms, for providing desired forms of ethnic or racial appearances.

The activity kit also includes instruction sheets 36 (FIG. 1 ), which preferably relate to activities for role playing using the doll. At least one activity for role-playing in a given adult career is provided, and preferably several. The particular adult careers or activities can be chosen from any of numerous examples. For purposes of explanation, a range of careers is represented in the drawings to include a veterinarian, a scientist, a hair dresser and/or a farmer. Sample instruction sheets 36 for each of the four mentioned careers read as follows.

WHAT DOES A SCIENTIST DO? (©1994 Jennifer Key Baker) A scientist uses the "Scientific Method" to study the physical world. Scientists collect data through observation and experiment, and the formulation and testing of hypotheses. The knowledge the scientists provide keep the world as we know it forever changing toward the future.

FAMOUS SCIENTIST: ELLEN HENRIETTA SWALLOW RICHARDS. Ellen Henrietta Swallow Richards was a chemist who lived from 1842–1911. Ellen was the first woman admitted to the Massachusetts Institute of Technology. She was one of the first environmentalists. She made sure that home furnishings and food and water were safe by testing them for toxic contaminants. She also developed safe sewage systems such as a system that prevented lead poisoning from water pipes. Ellen used her science skills to improve life for herself and for her family. She designed the plumbing for her own house before city water lines were in use and she also invented her own central heating system. Ellen Henrietta Swallow Richards used her knowledge in Science and her knowledge of homemaking in the time of industrialization to create what is known as Home Economics.

WHAT OTHER WORKING PEOPLE DOES A SCIENTIST DEPEND ON MOST? (Circle three.)

Veterinarian—Doctor—Artist—News Reporter—Mechanic Farmer—Musician—Business Woman—Hair Designer—Grocery Store Owner—Teacher

FILL IN THE BLANK:

If you invented a vaccine for the common cold you could sell the vaccine to a _____.

If your needed to draw a picture of the solar system for your new book you would hire a _____.

A _____ is the best person to educate others about your new discovery.

If you discovered a way to keep buds from destroying crops you would hire a _____ to sell it to _____s.

STEPS TO SUCCESS. To be a scientist you must:

Step one. Finish high school and get in classes on science, math and computers.

Step two. A four year college program is necessary. Study physics, chemistry, biology and math.

Step three. Get a master's degree in graduate school and pick a special area of interest to study.

Step four. Depending on your area of study you can get a job as a professor, a chemical engineer a biological scientist or a physicist.

FUN FACT: SMELLIEST SMELL. According to 1994 Guinness Book of Records the worlds "most evil smell" of the 17,000 smells so far classified may be a matter of opinion but ethyl mercaptan ($C_2H_5SH$) and butyl selenomercaptan ($C_4H_9SeH$) are pungent claimants, each with a smell reminiscent of a combination of rotting cabbage, garlic onions, burnt toast, and sewer gas.

FOR READING LIST AND MORE INFORMATION WRITE TO:

Office of Scientific Affairs
1325 Massachusetts Avenue NW
Washington D.C. 20005

WHAT DOES A FARMER DO? (©1994 Jennifer Key Baker) A farmer cultivates the land to raise food or livestock. There are even fish, tobacco and cotton farmers. Next time you go to the grocery store try to imagine where all the farms are that grow all of the food that you see.

FAMOUS FARMER: LUCY McWORTER. Lucy McWorter lived from 1771 to 1870. She was born a slave but became free when her husband Free Frank bought her freedom. Lucy and Frank supported themselves by running farms in Kentucky and Illinois. Lucy made butter, cheese, canned vegetables and fruits. She also manufactured cloth goods and raised bees and made honey and wax. Lucy and her husband Frank were successful farmers and they bought freedom for sixteen of their family members.

WHAT OTHER WORKING PEOPLE DOES A FARMER DEPEND ON MOST? (Circle three.)

Veterinarian—Doctor—Artist—News Reporter—Mechanic—Scientist—Musician—Business Woman—Hair Designer—Grocery Store Owner—Teacher.

FILL IN THE BLANK.

If your cow is sick you would take her to a_____.

If your tractor is broken you would call a _____ to fix it.

A _____ is the best person to predict the weather and you would probably get that information from a _____.

The best person to sell your product is a _____.

STEPS TO SUCCESS. To be a farmer you must:

Step one. Finish high school.

Step two. Get experience on a farm after school.

Step three. Enroll in a program offered by Future Farmers of America and 4-H.

Step four. Get a degree from a four year college of Agriculture and study soil and animal science, dairy science, horticulture, crops, agricultural economics, and mathematics.

FUN FACT: The largest pumpkin to date weighed 827 pounds. It was grown by J. Holland in Puyallup, Wash., USA.

FOR READING LIST AND MORE INFORMATION WRITE TO:

"AG In The Classroom"
U.S. Department of Agriculture
14th Street and Independence Avenue NW
Washington D.C. 20250

WHAT DOES A HAIR DESIGNER DO? (©1994 Jennifer Key Baker) A hair designer shampoos, cuts and styles hair. A license in cosmetology will also train you do be a make up artist and give you knowledge of general skin care. Some hair designers go on to own their own business or develop a line of beauty products.

FAMOUS HAIR DESIGNER: SARAH BREEDLOVE WALKER. Sarah Breedlove Walker was an inventor and a business owner in the beauty industry who lived from 1867 to 1919. She was born in Louisiana and was orphaned at the age of six, and married at age 14. By the time she was twenty years old she was widowed and began to support herself and her daughter by taking in washing clothes and working in a hair salon. During that time she claimed to have had a dream that gave her the formula for a hair grower for African-American hair. She began to sell the hair grower as well as shampoos and pomades door to door. Sarah was so successful that she expanded her sales force and moved to Denver, Colo. where she remarried and opened up her own beauty school. After ten years of hard work and dedication to her dream Sarah Breedlove Walker was finally a millionaire and president of a nationwide business of which she was the sole owner. Her company was called Mme. C. J. Walker Company. Because some of her product were used as hair straighteners Ms. Walker was criticized for trying to "whiten" her race. However she never labeled her product a straightener and she emphasized a pride in appearance that differed from that of the white culture. At the time of her death Sarah Breedlove Walker not only was a successful business woman in the beauty industry but was also a patron of the arts as well as a substantial donor in the area of education and her community.

WHAT OTHER WORKING PEOPLE DOES A HAIR DESIGNER DEPEND ON MOST? (Circle three.)

Doctor—Artist—News Reporter—Mechanic—Scientist—Business Woman— Veterinarian —Grocery Store Owner—Teacher

FILL IN THE BLANK:

If you need a sign painted for your salon you would call an _____.

If you were a hair designer that invented a new product for hair you would consult a _____ and a _____.

If you noticed something wrong on the scalp of one of your clients you would refer them to a _____.

Your new hair styles are in a fashion show. Your name would get known more if a _____ did a report about you on TV.

STEPS TO SUCCESS. To be a hair designer you must:

Step one. Finish high school.

Step two. Graduate from a state-licensed cosmetology school and complete 1,200–2,000 hours of classes and training.

Step three. Pass a physical exam and pass a written and skills examination.

Step four. Get a job working in an existing salon or staff your own business.

FUN FACT: "TWICE AS LONG AS SHE IS TALL". As of March in 1993 Diane Witt of Worcester, Mass. USA was documented as the person with the longest hair ever on earth. Her hair was measured at 12 feet and eight inches long. Because it can take several hours to wash and comb, Diane usually keeps it out of the way by braiding it and piling it high up on top of her head.

FOR A READING LIST AND MORE INFORMATION WRITE TO:

Association of American Cosmetology

WHAT DOES A VETERINARIAN DO? (©1994 Jennifer Key Baker) A Veterinarian treats sick and injured animals. They perform surgery and also prescribe drugs, medicine and vaccines. Some Veterinarians specialize in family pets. Other Vets treat livestock and work animals on farms and some work with animals in zoos and aquariums.

FAMOUS VETERINARIAN: SUZY JACKSON. Born in Britain in 1946 Suzy Jackson Graduated from Veterinary School in 1978. Instead of opening up a regular office she went to work as a crusader for animal rights. Suzy Jackson worked for a group people who rescued dancing bears who were held in captivity and mistreated by gypsies. After spotting the bears dancing in the city the animal rights activists would follow the gypsies back to the villages and go in with a team of police officers. The bears would be captured and taken back to a animal hospital. At the animal hospital Suzy Jackson would treat their cuts and wounds and look for signs of infection or disease. After treating any illness and becoming healthy the bears would be returned to the wild.

WHAT OTHER WORKING PEOPLE DOES A VETERINARIAN DEPEND ON MOST? (Circle three.)

Doctor—Artist—News Reporter—Mechanic—Scientist—Business Woman—Hair Designer—Grocery Store Owner—Teacher.

FILL IN THE BLANK.

If you need a sign painted for your office you would call an _____.

If your office was in the country you might get most of your business from a _____.

If you ran across a mysterious disease while treating an animal you might call your old _____ for advice on how to handle the situation.

You depend on _____ to invent new medicines for the animals that you treat.

STEPS TO SUCCESS. To be a veterinarian you must:

Step one. Finish high school. Focus on biology.

Step two. Take two years of pre-veterinary medicine.

Step three. Take four years of study at an accredited veterinary college.

Step four. Get a job working with an existing office or start your own business.

FUN FACT: "YOU LUCKY DOG". Some times when people die they leave all of their money to their pet. In 1931 Miss Ella Wendel of New York, N.Y., USA, left $75 million to her poodle, Toby.

FOR A READING LIST AND MORE IN FORMATION WRITE TO:

Association of American Veterinary Medical Colleges
1101 Vermont Avenue, Suite 710
Washington, DC 20005

Figure 9A:
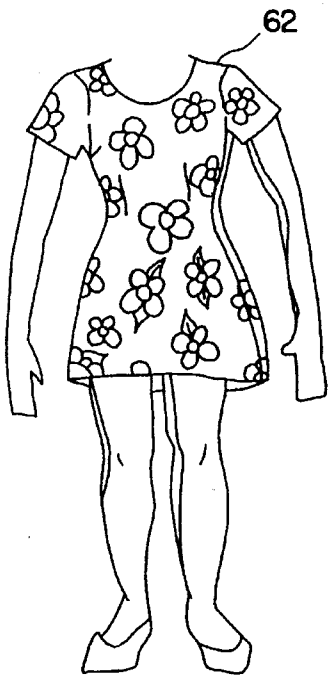
FIGS. 9*a*–9*d* depict front views of various embodiments of the wardrobe packaged in the carrying case in FIG. 1, in particular showing alternative career situations, FIG. 9*a* representing a wardrobe for a hair designer.
Figure 9B:
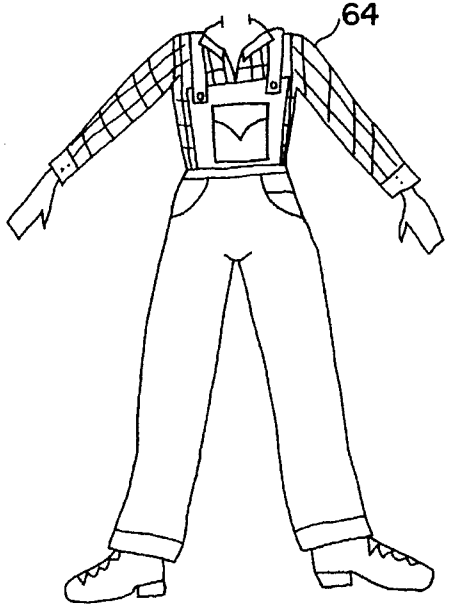
Figure 9C:
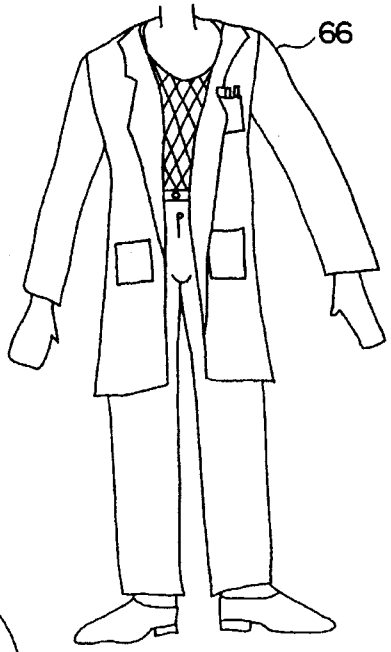
Figure 9D:
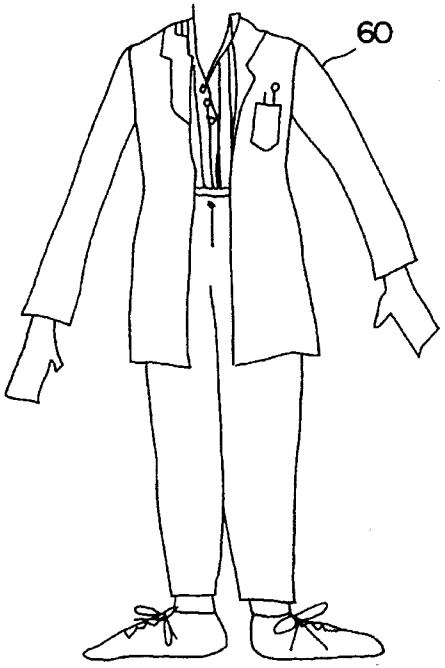

With reference to FIGS. 9*a*–9*b*, various wardrobes 32 are styled to match a given adult career of a chosen instruction sheet 36. FIG. 9*a* depicts a casual dress outfit 62 for the hairdresser. FIG. 9*b* shows a farmer's outfit 64 with denim overalls, plaid shirt and a pair of work-boots. In FIG. 9*c*, the veterinarian's wardrobe 66 includes khaki pants, a scoop neck shirt, comfortable shoes and a lab coat. The scientist's wardrobe 68 as depicted in FIG. 9*d* includes navy work pants, an oxford button-down shirt, sneakers and a white lab coat. These wardrobes correspond more closely to what may actually adorn real life persons than the wardrobes so typically provided for the prom queen dolls that dominate the toy market, such as the formal ball gowns and one-piece bathing suits provided for policewoman wardrobes.

Figure 10B:
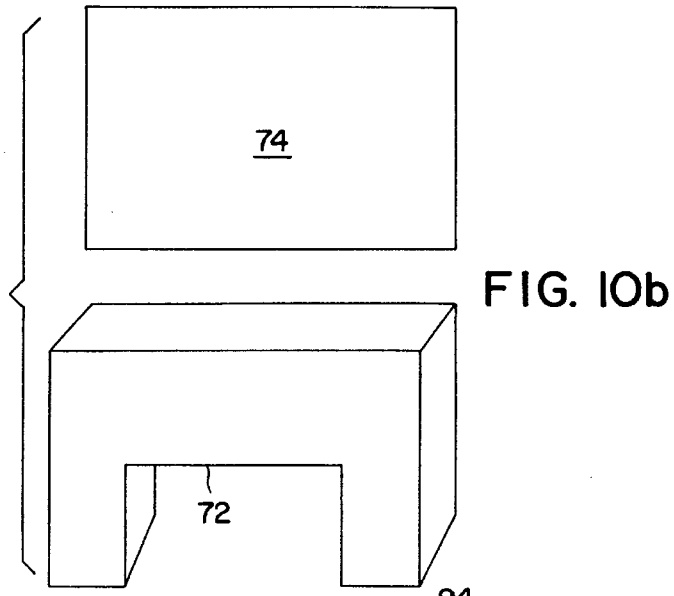
FIGS. 10*a*–10*d* depict various embodiments of the props packaged in the carrying case in FIG. 1, preferably corresponding to the career situations of the wardrobes as in FIGS. 9*a*–9*d*, FIG. 10*a* showing props appropriate for the farmer wardrobe.
Figure 10D:
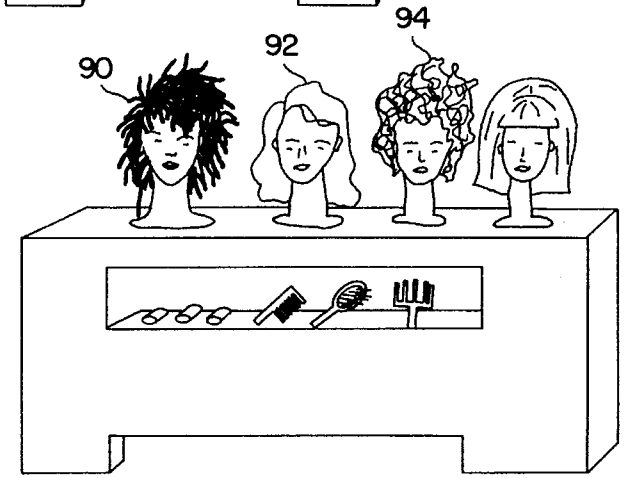
Figure 10A:
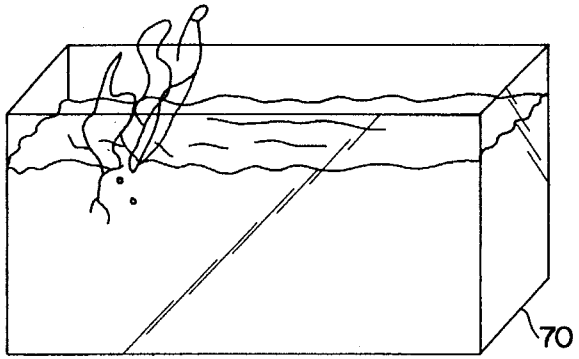
Figure 10C:
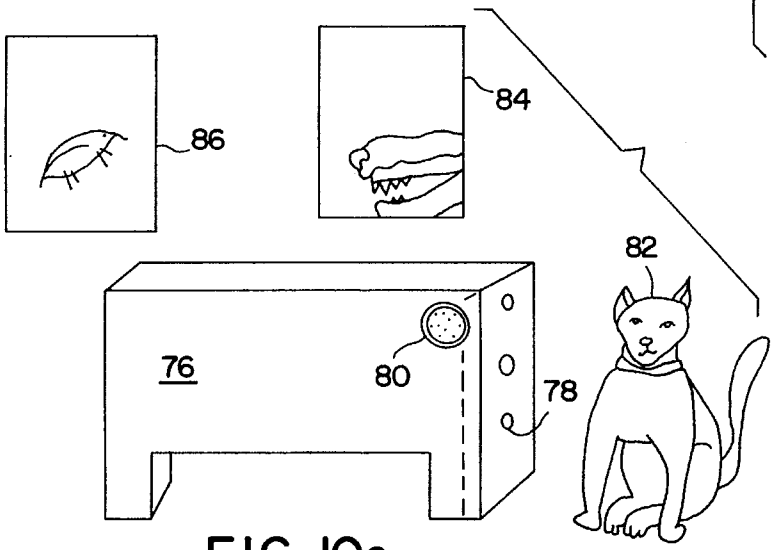

In FIGS. 10*a*–10*c*, props 34 chosen to correspond to the career of a given instruction sheet 36 and matching wardrobe 32 include the following. A terrarium, soil sample and seeds 70 as shown in FIG. 10*a* provide the farmer career with an appropriately scaled agricultural activity. FIG. 9*b* shows the props for a scientist's activity, including a lab bench 72 and periodic chart of the elements 74. The activity can comprise filling a mixing bowl halfway with water and then sealing the bowl with plastic wrap: the process of condensation of water vapor on the plastic wrap which then drips down provides a demonstration of rainfall in the atmosphere. In FIG. 10*c*, the veterinarian's props might include an examination table 76 with pushbuttons 78 for actuating prerecorded sounds via a loudspeaker 80 such as barking, mewing, or heartbeats. There also is at least one patient 82 as a dog or a cat, and charts that deal with taking care of teeth 84 or getting rid of fleas 86. FIG. 10*d* shows the props for a hairdresser, which includes four hair styles ranging from dreadlocks 90, a pageboy 92, and permed hair 94, to a bob 96. The props further include curlers, a comb, a brush and/or a pick. Various additional educational activities associated with roll playing in careers or in other adult pursuits are also possible.

The combination 10 diverse doll 12 and educational activity playset 14 provide children and mothers with the versatility mix and match parts to come up with their own custom-chosen doll and future by providing a variety in the selections of facial appearances, hairstyles, wardrobes, careers, and/or activities. The children's play-acting with the doll 12 is enriching because the activities emphasize educational lessons. The dolls 12 and playsets 14 permit the mothers to add in their own everyday and workday anecdotes and experiences to the play-acting because the doll engages in role-playing activities which might be real-life for the mother.

Two children can role-play in different ones of the careers and can play at exchanging services. A simple example may have a hair dresser providing a veterinarian with a shampoo and cut in return for veterinary services for the hair dresser's pet. A more complex example may have a farmer providing a scientist with organic food in return for evening courses in environmental sciences. Whatever the level of play, two companions playing with diverse dolls 12 can select different ones of the ethnic and/or racial appearances or other aspects as they consider appropriate, wherein peaceful play together will promote acceptability in diversity, which is a rewarding lesson that cannot be learned too early in a democratic world.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of educational play with a combination doll and an adult activity, educational playset, comprising the steps of:

providing a plurality of alternative doll wigs;

providing a plurality of alternative doll heads and forming the doll heads to include interchangeable means for receiving a given wig chosen from the plurality of alternative doll wigs and a releasable locking means for releasably locking the heads onto a doll body;

providing a doll body and forming the body with interchangeable means for receiving a given doll head chosen from the plurality of alternative doll heads, said doll body with made from a moldable material, said moldable material being molded into a female form with enlarged waist, hips and legs to simulate non-ideal, obvious surplus body fat in the waist, hips and legs;

choosing from among the alternative doll wigs and doll head and assembling the doll body with the chosen wig and head to form the doll;

providing a plurality of adult activity, educational playsets for role-playing in a given adult activity, wherein a given adult activity, educational playset is a kit of at least two items selected from the group consisting of an adult activity instruction sheet, an adult activity prop, an adult activity gameboard, and a wardrobe, sized and proportioned to adorn the doll body, styled in a manner to complement role-playing in the corresponding, given adult activity;

choosing from among the adult activity playsets and outfitting the doll in the wardrobe of the given adult activity; and, allowing the user to role play in the given adult activity, the user being limited in role-playing with the doll in the given adult activity such that the role-playing occurs from the vantage point of an adult with non-idealized rather than idealized proportions in the waist, hips, and legs by virtue of the doll body having obvious surplus fat in the waist, hips and legs, whereby the user is freed of social pressure and apprehensions respecting appearance while role-playing with said combination doll and adult activity, educational playset.

2. The method of educational play with the combination of claim 1, further comprising the steps of providing a carrying case and a selection of props for complementing the adult activities.

3. The method of educational play with the combination of claim 2, wherein the step of providing the carrying case further comprises the steps of arranging the carrying case to be releasably closable and sized for containing the wardrobe, props, doll body and head and wig.

* * * * *